US011725254B2

(12) United States Patent
Han et al.

(10) Patent No.: US 11,725,254 B2
(45) Date of Patent: Aug. 15, 2023

(54) METHOD FOR MANUFACTURING GRAIN-ORIENTED ELECTRICAL STEEL SHEET

(71) Applicant: POSCO, Pohang-si (KR)

(72) Inventors: Min Soo Han, Pohang-si (KR); Hyung Don Joo, Pohang-si (KR); Jong Ho Park, Pohang-si (KR); Chang Soo Park, Pohang-si (KR); Byung Deug Hong, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 673 days.

(21) Appl. No.: 16/065,774

(22) PCT Filed: Dec. 23, 2016

(86) PCT No.: PCT/KR2016/015230
§ 371 (c)(1),
(2) Date: Jun. 22, 2018

(87) PCT Pub. No.: WO2017/111551
PCT Pub. Date: Jun. 29, 2017

(65) Prior Publication Data

US 2019/0010572 A1 Jan. 10, 2019

(30) Foreign Application Priority Data

Dec. 24, 2015 (KR) ..... 10-2015-0186226

(51) Int. Cl.
*C21D 9/46* (2006.01)
*C22C 38/02* (2006.01)
(Continued)

(52) U.S. Cl.
CPC ..... *C21D 9/46* (2013.01); *C21D 6/008* (2013.01); *C21D 8/005* (2013.01); *C21D 8/0205* (2013.01);
(Continued)

(58) Field of Classification Search
None
See application file for complete search history.

(56) References Cited

U.S. PATENT DOCUMENTS 4,268,326 A * 5/1981 Iwayama ..... C21D 3/04 148/113
4,421,574 A * 12/1983 Lyudkovsky ..... C21D 8/12 148/111
(Continued)

FOREIGN PATENT DOCUMENTS

CN 102041368 A 5/2011
CN 104884646 A 9/2015
(Continued)

OTHER PUBLICATIONS

KR 10-2013-0026243 machine translation (Year: 2013).*
(Continued)

*Primary Examiner* — Paul A Wartalowicz
*Assistant Examiner* — Stephani Hill
(74) *Attorney, Agent, or Firm* — Morgan, Lewis & Bockius LLP

(57) ABSTRACT

A method for manufacturing grain-oriented electrical steel sheet includes: manufacturing a steel slab having at least one of 2 wt % to 7 wt % of Si, 0.03 wt % to 0.10 wt % of Sn, and 0.01 wt % to 0.05 wt % of Sb; hot-rolling the steel slab to produce a hot-rolled sheet; cold-rolling the hot-rolled sheet to produce a cold-rolled sheet; primary recrystallization-annealing the cold-rolled sheet; applying an annealing separator to the primary recrystallization-annealed cold-rolled sheet and drying the same; and secondary recrystallization-annealing the cold-rolled sheet on which the annealing separator is applied. The primary recrystallization-annealing is performed so that the thickness of an oxide layer formed on the surface of the cold-rolled sheet is 0.5 μm to 2.5 μm, and the oxygen amount of the oxide layer is 600
(Continued)

ppm or more after the primary recrystallization-annealing, and in which a forsterite ($Mg_2SiO_4$) film can be removed in the secondary recrystallization-annealing.

15 Claims, 6 Drawing Sheets

(51) Int. Cl.

| | |
|---|---|
| ***C21D 8/12*** | (2006.01) |
| ***C22C 38/60*** | (2006.01) |
| ***C22C 38/04*** | (2006.01) |
| ***C23C 8/80*** | (2006.01) |
| ***C21D 8/02*** | (2006.01) |
| ***C21D 6/00*** | (2006.01) |
| ***C21D 8/00*** | (2006.01) |
| ***C22C 38/00*** | (2006.01) |

(52) U.S. Cl.
CPC ..... *C21D 8/0226* (2013.01); *C21D 8/0236* (2013.01); *C21D 8/0257* (2013.01); *C21D 8/0263* (2013.01); *C21D 8/0273* (2013.01); *C21D 8/1255* (2013.01); *C21D 8/1272* (2013.01); *C21D 8/1283* (2013.01); *C22C 38/002* (2013.01); *C22C 38/008* (2013.01); *C22C 38/02* (2013.01); *C22C 38/04* (2013.01); *C22C 38/60* (2013.01); *C23C 8/80* (2013.01)

(56) References Cited

U.S. PATENT DOCUMENTS

| | | | | | |
|---|---|---|---|---|---|
| 5,507,883 | A * | 4/1996 | Tanaka | C21D 8/1283 | 148/111 |
| 5,718,775 | A * | 2/1998 | Komatsubara | C21D 3/02 | 420/117 |
| 2003/0116236 | A1 | 6/2003 | Hayakawa et al. | | |
| 2016/0020006 | A1 * | 1/2016 | Watanabe | C21D 3/04 | 148/111 |
| 2016/0194731 | A1 * | 7/2016 | Han | C22C 38/008 | 148/111 |

FOREIGN PATENT DOCUMENTS

| | | | | |
|---|---|---|---|---|
| EP | 2940161 | A1 | 11/2015 | |
| JP | S53-022113 | A | 3/1978 | |
| JP | H06-100937 | A | 4/1994 | |
| JP | H06-100997 | A | 4/1994 | |
| JP | H06-200325 | A | 7/1994 | |
| JP | 06-256848 | A | 9/1994 | |
| JP | 11-036018 | A | 2/1999 | |
| JP | 2003-034821 | A | 2/2003 | |
| JP | 2003-253334 | A | 9/2003 | |
| JP | 2003-268451 | A | 9/2003 | |
| JP | 2012-087332 | A | 5/2012 | |
| JP | 2014-152392 | A | 8/2014 | |
| KR | 1020130026243 | * | 3/2013 | |
| KR | 10-2013-0071969 | A | 7/2013 | |
| KR | 10-2014-0084898 | A | 7/2014 | |
| KR | 10-2014-0092467 | A | 7/2014 | |
| WO | WO-2014104762 | A1 * | 7/2014 | C21D 9/46 |
| WO | WO-2014126089 | A1 * | 8/2014 | H01F 41/02 |

OTHER PUBLICATIONS

International Search Report issued in corresponding International Application No. PCT/KR2016/015230, dated Apr. 6, 2017.
Chinese Office Action dated May 5, 2019 issued in Chinese Patent Application No. 201680076201.7 (with English translation).
Extended European Search Report dated Sep. 13, 2018 issued in European Patent Application No. 16879418.8.
Japanese Office Action dated Aug. 6, 2019 issued in Japanese Patent Application No. 2018-533211.

* cited by examiner

METHOD FOR MANUFACTURING GRAIN-ORIENTED ELECTRICAL STEEL SHEET

CROSS REFERENCE

This patent application is the U.S. National Phase under 35 U.S.C. § 371 of International Application No. PCT/KR2016/015230, filed on Dec. 23, 2016, which claims the benefit of Korean Patent Application No. 10-2015-0186226, filed on Dec. 24, 2015, the entire contents of each are hereby incorporated by reference.

TECHNICAL FIELD

The present disclosure relates to the method for manufacturing the grain-oriented electrical steel sheet.

BACKGROUND ART

A grain-oriented electrical steel sheet includes 3.1% of a Si component and has a texture in which an orientation of grains is arrayed in a {110}<001> direction. Because the product has an extremely excellent magnetic characteristic in a rolling direction, the product is used as an iron core material of a transformer, a motor, a generator, and other electrical devices using the characteristic.

Recently, while an oriented electrical steel sheet having a level of a high magnetic flux density is commercially available, a material having small iron loss has been requested. The iron loss may be enhanced with four technical methods including i) a method of accurately orienting a {110}<001> grain direction of a magnetic easy axis of an oriented electrical steel sheet in a rolling direction, ii) a method of forming a material in a thin thickness, iii) a method of minutely forming a magnetic domain through a chemical and physical method, and iv) a method of enhancing a surface property or imparting surface tension by a chemical method such as surface treatment.

The method as described finally is a method of enhancing the magnetic properties of the material by actively improving the properties of the surface of the grain oriented electrical steel sheet. As the typical example thereof, a method of removing forsterite ($Mg_2SiO_4$), that is, a base coating layer, which is produced through a chemical reaction of a MgO slurry which is an anti-sticking agent of a coil and an oxide layer necessarily generated in the decarburization annealing process.

The technique for removing the base coating layer includes a method for forcibly removing a base coating layer formed on the conventional product with sulfuric acid or hydrochloric acid and a method for removing or suppressing the base coating layer during its production (hereinafter referred to as glassless technology).

Up to recently, the leading research direction of the glassless technology has proceeded in two directions: a technique of using a surface etching effect in a high-temperature annealing process after adding chlorides to MgO, an annealing separator and a technique of applying $Al_2O_3$ powder as an annealing separator, thereby not forming a base coating layer itself in a high temperature annealing process.

The ultimate direction of such technology is to intentionally prevent the base coating layer in the production of electrical steel sheets, thereby removing the surface pinning sites that lead to magnetic deterioration so as to improve the magnetic properties of the grain-oriented electrical steel sheet eventually.

Both of glassless methods as described above, namely, the method of suppressing the formation of the forsterite layer and the technique of separating the base coating layer from the base material in the high-temperature annealing process have the common problem that the oxidizing ability ($P_{H2O}/P_{H2}$) should be controlled very low in the furnace through the hydrogen and nitrogen gas and dew-point changes in the decarburization annealing process. The reason for controlling the oxidizing ability to be lowered is that the oxide layer formed on the surface of the base material during the decarburization process is minimized to inhibit the formation of the base coating layer maximally. Further, there is an advantage that when the oxidation ability is low in the furnace, the oxidation layer is mostly silica ($SiO_2$), thereby inhibiting the production of the iron-based oxide so that the iron-based oxide is not left on the surface thereof after the high-temperature annealing process. However, in such a case, it is difficult to secure a proper primary recrystallized grain size because of the decarburization defect and also cause a problem in secondary recrystallization grain growth at the high-temperature annealing. Thus, in order to secure the thin oxide layer while appropriately securing the decarburization ability, the time required for performing the decarburization process must be increased as compared with the ordinary treatment process. Due to this issue, its productivity is deteriorated There is a problem that an inhibitor present in the steel at the high-temperature annealing is rapidly diffused toward the surface thereof to disappear due to a thin oxide layer generated during the production of a grain-oriented electrical steel sheet having low iron-loss through the conventional glassless method, thereby causing the unstable secondary recrystallization. A method for addressing such a problem is to control the atmosphere at the high-temperature annealing and to apply a sequence pattern that slows the rate of temperature rise in the heating zone, thereby suppressing the diffusion of the inhibitor into the surface of the steel.

The method of controlling the oxidation ability to be lower and forming the oxide layer to the minimum to suppress the formation of the base coating layer as much as possible has the effect that the dew point and the temperature behavior vary depending on the position of the sheet in the coil when the steel is heat-treated in a type of a coil at the high-temperature annealing. Thus, there is a difference in the formation of the base coating layer, causing a difference in the degree of the glassless. Thus, there is a partial deviation in the sheet, which may be a big problem in mass production.

Accordingly, in order to manufacture a low iron-loss grain-oriented electric steel sheet through the conventional glassless process, it is inevitable to deteriorate the productivity in the decarburization process and the high-temperature annealing process. Thus, although the glassless process is technically beneficial, the process is not commercialized.

DISCLOSURE

Technical Problem

The present disclosure has been made in an effort to provide a method for manufacturing grain-oriented electrical steel sheet having advantages of having extremely low iron-loss and including an excellent process of removing forsterite (hereinafter, referred to as "base coating free" process) with excellent productivity.

Technical Solution

An exemplary embodiment of the present invention may provide a method for manufacturing grain-oriented electrical steel sheet, the method comprising: manufacturing a steel slab comprising one or more kinds of 2 wt % to 7 wt % of Si, 0.03 wt % to 0.10 wt % of Sn, and 0.01 wt % to 0.05 wt % of Sb; hot-rolling the steel slab to produce a hot-rolled sheet; cold-rolling the hot-rolled sheet to produce a cold-rolled sheet; primary recrystallization-annealing the cold-rolled sheet; applying an annealing separator to the primary recrystallization-annealed cold-rolled sheet and drying the same; and secondary recrystallization-annealing the cold-rolled sheet on which the annealing separator is applied.

Another embodiment of the present invention may provide a method for manufacturing grain-oriented electrical steel sheet in which the primary recrystallization-annealing is performed so that the thickness of an oxide layer formed on the surface of the cold-rolled sheet is 0.5 μm to 2.5 μm, and the oxygen amount of the oxide layer is 600 ppm or more after the primary recrystallization-annealing, and in which a forsterite ($Mg2_siO_4$) film can be removed in the secondary recrystallization-annealing.

Yet another embodiment of the present invention may provide a method for manufacturing grain-oriented electrical steel sheet in which the steel slab may comprise 2 wt % to 7 wt % of Si, 0.01 wt % to 0.085 wt % of C, 0.01 wt % to 0.045 wt % of Al, 0.01 wt % or less of N, 0.01 wt % to 0.05 wt % of P, 0.02 wt % to 0.5 wt % of Mn, 0.0055 wt % or less (excluding 0%) of S and one or more kinds of 0.03 wt % to 0.10 wt % of Sn and 0.01 wt % to 0.05 wt % of Sb, with the remainder being Fe and other unavoidable impurities.

Yet another embodiment of the present invention may provide a method for manufacturing grain-oriented electrical steel sheet in which the steel slab may comprise 0.01 wt % to 0.05 wt % of Sb and 0.01 wt % to 0.05 wt % of P and satisfy $0.0370 \leq [P]+0.5*[Sb] \leq 0.0630$ (wherein [P] and [Sb], respectively refer to P content (wt %) and Sb content (wt %)).

Yet another embodiment of the present invention may provide a method for manufacturing grain-oriented electrical steel sheet in which the primary recrystallization-annealing may be performed through a heating zone, a first soaking zone, a second soaking zone and a third soaking zone, and the temperatures of the heating zone, the first soaking zone, the second soaking zone, and the third soaking zone may be 800° C. to 900° C.

Yet another embodiment of the present invention may provide a method for manufacturing grain-oriented electrical steel sheet in which a dew-point of the heating zone may be 44° C. to 49° C., a dew-point of the first soaking zone may be 50° C. to 55° C., a dew-point of the second soaking zone is 56° C. to 68° C., and a dew-point of the third soaking zone may be 35° C. to 65° C.

Yet another embodiment of the present invention may provide a method for manufacturing grain-oriented electrical steel sheet in which the oxidation ability ($P_{H2O}/P_{H2}$) of the heating zone may be 0.197 to 0.262, the oxidation ability of the first soaking zone may be 0.277 to 0.368, the oxidation ability of the second soaking zone may be 0.389 to 0.785, and the oxidation ability of the third soaking zone may be 0.118 to 0.655.

Yet another embodiment of the present invention may provide a method for manufacturing grain-oriented electrical steel sheet in which the process time for the heating zone and the first soaking zone may be 30% or less of the total process time of the primary recrystallization-annealing, and the process time for the third soaking zone may be limited to 50% or less of the total process time of the heating zone, the first soaking zone, and the second soaking zone.

Yet another embodiment of the present invention may provide a method for manufacturing grain-oriented electrical steel sheet in which after the primary recrystallization annealing, a base metal layer, a segregation layer, and an oxide layer may be sequentially formed, and the segregation layer may include 0.001 wt % to 0.05 wt % of one or more kinds of Sb and Sn.

Yet another embodiment of the present invention may provide a method for manufacturing grain-oriented electrical steel sheet in which the annealing separator may include MgO, an oxychloride material, and a sulfate-based antioxidant.

Yet another embodiment of the present invention may provide a method for manufacturing grain-oriented electrical steel sheet in which the annealing separator may have MgO with an activativity of 400 seconds to 3000 seconds.

Yet another embodiment of the present invention may provide a method for manufacturing grain-oriented electrical steel sheet in which the annealing separator may include 10 parts by weight to 20 parts by weight of the oxychloride material and 1 parts by weight to 5 parts by weight of the sulfate-based antioxidant, based on 100 parts by weight of MgO.

Yet another embodiment of the present invention may provide a method for manufacturing grain-oriented electrical steel sheet in which the oxychloride material may include at least one selected from antimony oxychloride (SbOCl) and bismuth oxychloride (BiOCl).

Yet another embodiment of the present invention may provide a method for manufacturing grain-oriented electrical steel sheet in which the sulfate-based antioxidant may include at least one selected from antimony sulfate ($Sb_2(SO_4)_3$), strontium sulfate ($SrSO_4$) and barium sulfate ($BaSO_4$).

Yet another embodiment of the present invention may provide a method for manufacturing grain-oriented electrical steel sheet in which the application amount of the annealing separator may be 6 g/m$^2$ to 20 g/m$^2$.

Yet another embodiment of the present invention may provide a method for manufacturing grain-oriented electrical steel sheet in which the temperature for drying the annealing separator may be 300° C. to 700° C.

Yet another embodiment of the present invention may provide a method for manufacturing grain-oriented electrical steel sheet in which the heating rate may be 18° C./hour to 75° C./hour in a temperature range of 700° C. to 950° C., and the heating rate may be 10° C./hour to 15° C./hour in a temperature range of 950° C. to 1200° C. in the secondary recrystallization annealing.

Yet another embodiment of the present invention may provide a method for manufacturing grain-oriented electrical steel sheet in which the heating at 700° C. to 1200° C. may be performed in an atmosphere containing 20 volume % to 30 volume % of nitrogen and 70 volume % to 80 volume % of hydrogen, followed by performing in an atmosphere containing 100 volume % of hydrogen after reaching 1200° C. in the secondary recrystallization annealing.

Yet another embodiment of the present invention may provide a method for manufacturing grain-oriented electrical steel sheet having a surface roughness of 0.8 μm or less in terms of Ra.

Yet another embodiment of the present invention may provide a method for manufacturing grain-oriented electrical steel sheet of which a groove parallel to the rolling direction may be formed on the surface.

Yet another embodiment of the present invention may provide a method for manufacturing grain-oriented electrical steel sheet in which the groove may have a length of 0.1 mm to 5 mm in the rolling direction and a width of 3 μm to 500 μm.

Yet another embodiment of the present invention may provide a method for manufacturing grain-oriented electrical steel sheet in which the groove having a length of 0.2 mm to 3 mm in the rolling direction and a width of 5 μm to 100 μm may be 50% or more.

Advantageous Effects

According to an embodiment of the present disclosure, the oxide layer produced in the primary recrystallization annealing process and the magnesium oxide (MgO) present in the annealing separator form a forsterite ($Mg_2SiO_4$) film produced through a chemical reaction in the secondary recrystallization annealing process, so that the film can be evenly removed so as to control the surface properties of the grain-oriented electrical steel sheet.

According to another embodiment of the present disclosure, the grain-oriented electrical steel sheet with the forsterite film removed can exclude the pinning point, which is the primary factor of limiting magnetic domain movement and can lower the iron loss of grain-oriented electrical steel sheets.

MODE FOR INVENTION

The terms "first," "second," "third" and the like are used to illustrate different parts, components, areas, layers and/or sections, but are not limited thereto. The terms are only used to differentiate a specific part, component, area, layer or section from another part, component, area, layer or section. Accordingly, a first part, component, area, layer or section, which will be mentioned hereinafter, may be referred to as a second part, component, area, layer or section without departing from the scope of the present disclosure.

The technical terms used herein are set forth to mention specific embodiments of the present disclosure and do not intend to define the scope of the present disclosure. The singular number used here includes the plural number as long as the meaning of the singular number is not distinctly opposite to that of the plural number. The term "have," used herein refers to the concretization of a specific characteristic, region, integer, step, operation, element and/or component, but does not exclude the presence or addition of other characteristic, region, integer, step, operation, element and/or component.

When it is said that any part is positioned "on" or "above" another part, it means the part is directly on the other part or above the other part with at least one intermediate part. In contrast, if any part is said to be positioned "directly on" another part, it means that there is no intermediate part between the two parts.

Unless otherwise specified, all the terms including technical terms and scientific terms used herein have the same meanings commonly understandable to those skilled in the art relating to the present disclosure. The terms defined in generally used dictionaries are additionally interpreted to have meanings corresponding to relating scientific literature and contents disclosed now, and are not interpreted either ideally or very formally unless defined otherwise.

Hereinafter, exemplary embodiments of the present disclosure will be described in detail so that a person having ordinary knowledge in the art to which the present disclosure belongs can easily carry out the present disclosure. As those skilled in the art would realize, the described embodiments may be modified in various different ways, all without departing from the spirit or scope of the present invention.

Figure 1:
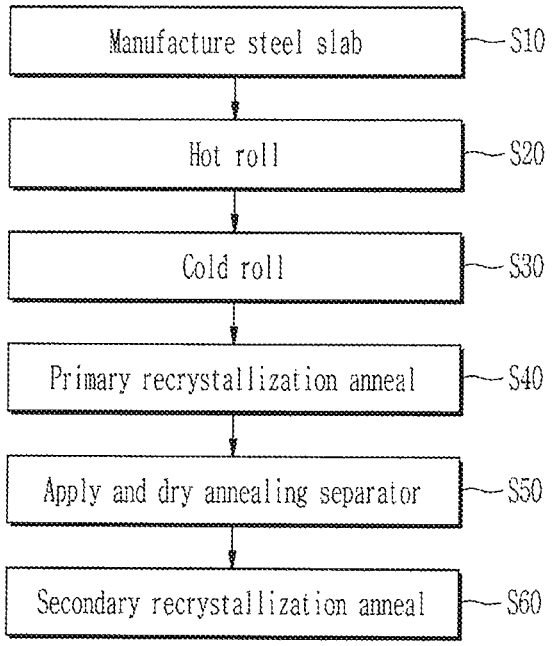
FIG. 1 is a schematic flowchart of the method of manufacturing the grain oriented electrical steel sheet according to an exemplary embodiment of the present disclosure.

FIG. 1 is a schematic flowchart of the method of manufacturing the grain oriented electrical steel sheet according to an exemplary embodiment of the present disclosure. The flowchart of the method of manufacturing the grain oriented electrical steel sheet of FIG. 1 is merely for illustrating the present disclosure, and the present disclosure is not limited thereto. Therefore, the method of manufacturing the grain oriented electrical steel sheet may be modified variously.

The method of manufacturing the grain-oriented electrical steel sheet according to an exemplary embodiment of the present disclosure comprises manufacturing a steel slab comprising at least one of 2 wt % to 7 wt % of Si, 0.03 wt % to 0.10 wt % of Sn, and 0.01 wt % to 0.05 wt % of Sb (S10); hot-rolling the steel slab to produce a hot-rolled sheet (S20); cold-rolling the hot-rolled sheet to produce a cold-rolled sheet (S30); primary recrystallization-annealing the cold-rolled sheet (S40); applying an annealing separator to the primary recrystallization-annealed cold-rolled sheet and drying the same (S50); and secondary recrystallization-annealing the cold-rolled sheet on which the annealing separator is applied (S60).

First, in step S10, a steel slab comprising at least one of 2 wt % to 7 wt % of Si, 0.03 wt % to 0.10 wt % of Sn, and 0.01 wt % to 0.05 wt % of Sb is manufactured. Here, each of Sn and Sb may be included individually, or both may be included together. Si, Sn, or Sb is an essential element included in one exemplary embodiment of the present disclosure, and other C, Al, N, P, Mn, and the like may be included additionally.

Specifically, the steel slab may comprise Si: 2 wt % to 7 wt % of Si, 0.01 wt % to 0.085 wt % of C, 0.01 wt % to 0.045 wt % of Al, 0.01 wt % or less of N, 0.01 wt % to 0.05 wt % of P, 0.02 wt % to 0.5 wt % of Mn, 0.0055 wt % or less (excluding 0%) of S and one or more kinds of 0.03 wt % to 0.10 wt % of Sn and 0.01 wt % to 0.05 wt % of Sb, with the remainder being Fe and other unavoidable impurities.

When the steel slab includes 0.01 wt % to 0.05 wt % of Sb and 0.01 wt % to 0.05 wt % of P, it may satisfy $0.0370 \leq [P]+0.5*[Sb] \leq 0.0630$ (wherein [P] and [Sb], respectively refer to P content (wt %) and Sb content (wt %). When the relation as described above is satisfied, the iron loss of the grain-oriented electrical steel sheet can be further lower, and the magnetic flux density thereof can be further improved.

Hereinafter, each composition of the steel slab is described in detail.

Si: 2 wt % to 7 wt %

Si is an elemental composition of the electrical steel sheet, which functions to lower the iron loss (core loss) by increasing the specific resistance of the material.

When the Si content is too low, the specific resistance decreases, the eddy current loss increases, and thus the iron loss characteristics deteriorate. Further, during the decarburization-nitriding annealing, the primary recrystallization texture may be severely damaged due to the active phase transformation between ferrite and austenite. Further, during the high-temperature annealing, the phase transformation occurs between ferrite and austenite so that the secondary recrystallization may become unstable, as well as {110} Goss texture may be severely damaged.

On the other hand, when the Si content of is too high, $SiO_2$ and $Fe_2SiO_4$ oxide layers are formed excessively densely on the primary recrystallization annealing, thereby delaying the decarburization behavior so that the phase transformation between ferrite and austenite continues during the primary recrystallization annealing so as to damage the primary recrystallization texture badly. Further, due to the delayed decarburization behavior caused by the dense oxide layer formation, the nitriding behavior is delayed so that nitrides such as (Al, Si, Mn)N and AlN are not sufficiently formed. Thus, sufficient grain inhibition necessary for the secondary recrystallization may not be ensured in the secondary recrystallization annealing. Therefore, the Si content may be controlled to the range as described above.

C: 0.01 wt % to 0.085 wt %

C is an element that causes phase transformation between ferrite and austenite, which is an essential element for enhancing the rolling property of an electrical steel sheet having poor rolling property due to a high brittleness. However, C is an element for deteriorating the magnetic properties due to a carbide formed by a magnetic aging effect when C remains in the final product. Thus, C may be controlled to appropriate content.

When the C content is too low, the phase transformation between ferrite and austenite is not adequately performed, resulting in nonuniformity of microstructure of the slab and hot rolled sheet. Further, when the phase transformation between ferrite and austenite is not performed excessively during the heat treatment of the hot rolled sheet-annealing, the precipitation re-dissolved during the re-heating of the slab becomes coarse, resulting in nonuniformity of the primary recrystallization microstructure. It leads to lack of grain growth inhibitor during the secondary recrystallization annealing, resulting in unstable secondary recrystallization annealing behavior.

On the other hand, when the C content is too high, a conventional first recrystallization process cannot provide sufficient decarburization, and thus it can be a problem of removing C efficiently. Furthermore, the insufficient decarburization may cause deterioration of magnetic properties due to magnetic aging when the final product is applied to electric power equipment. Therefore, the C content may be controlled to the range as described above.

Al: 0.01 wt % to 0.045 wt %

Al is precipitated in the form of fine AlN during hot-rolling and hot rolled sheet-annealing. Al also forms nitride in the form of (Al,Si,Mn)N or AlN in which nitrogen ion, which is introduced by ammonia gas during the annealing after the cold-rolling, is combined with Al, Si, and Mn, which are dissolved in the steel. These are performed as a strong grain growth inhibitor When the Al content is too low, the number and volume to be formed are considerably low. Thus, the inhibitor cannot be expected to elicit a sufficient effect.

When the Al content is too high, the coarse nitride is formed to deteriorate the crystal growth inhibiting ability. Therefore, the Al content may be controlled to the range as described above.

N: 0.01 wt % or less (excluding 0 wt %)

N is a critical element that reacts with Al to form AlN.

When the N content of N is too high, the nitrogen diffusion causes surface defects, which are called blisters, in the process after the hot-rolling. Further, nitrides are formed too much in the slab state so that the rolling is difficult and the post process is complicated, causing an increase in the production cost.

Meanwhile, N is further necessary for forming nitrides such as (Al, Si, Mn)N or AlN. Thus, N may be supplemented by nitriding treatment for the steel using ammonia gas in the primary recrystallization annealing S40 as described below. Therefore, the N content may be controlled to the range as described above.

P: 0.01 wt % to 0.05 wt %

P promotes the growth of the primary recrystallized grain in low-temperature heating-type grain-oriented electrical steel sheets, thereby increasing the secondary recrystallization temperature to enhance the integration of the {110}<001> orientation in the final product. When the primary recrystallized grain is too large, the second recrystallization becomes unstable. However, the large primary recrystallized grain is beneficial for magnetism for increasing the secondary recrystallization temperature as long as the second recrystallization takes place.

On the other hand, P not only increase the number of grains having {110}<001> orientation in the primary recrystallized steel sheet so as to reduce the iron loss of the final product, but also actively develops the {111}<112> texture in the primary recrystallized sheet to enhance integration of {110}<001> of the final product is improved, thereby increasing the magnetic flux density.

Further, P is segregated in grain boundaries to a high temperature of about 1000° C. during the secondary recrystallization annealing, thereby retarding the decomposition of precipitates to reinforce the inhibiting effect.

When the P content is too high, the size of the primary recrystallized grain is rather reduced, which may not only cause instability of the secondary recrystallization but also increase the brittleness to decrease the cold-rolling property. Therefore, the P content may be controlled to the range as described above.

Mn: 0.02 wt % to 0.5 wt %

Mn is an important element because Mn has the effect of increasing the specific resistance same as that of Si so as to decrease the eddy current loss, thereby reducing the total iron loss, and Mn reacts with the nitrogen introduced by the nitriding treatment together with Si so as to form precipitates of (Al,Si,Mn)N, thereby inhibiting growth of the primary recrystallized grain to cause the secondary recrystallization. When Mn is added in 0.20 wt % or more, Mn is excessively added in the surface of the steel sheet, and thus other (Fe,Mn) and Mn oxides are largely formed in addition to $Fe_2SiO_4$ in the oxide layer on the surface of the steel sheet. The oxides inhibit a formation of a base coating during the high-temperature annealing to decrease the surface quality. Further, they induce phase transformation between ferrite and austenite in the secondary recrystallization annealing S60, so that the texture may be severely damaged and the magnetic properties may be significantly deteriorated. Therefore, the Mn content may be controlled to the range as described above.

S: 0.0055 wt % or less (excluding 0 wt %)

S is an essential element that reacts with Mn to form MnS.

When the S content is too high, precipitates of MnS are formed in the slab to inhibit the crystal grain growth. Further, they may be segregated at the center of the slab during the casting so that it is difficult to control the microstructure in the subsequent process. Therefore, the S content may be controlled to the range as described above.

At least one of Sn: 0.03 wt % to 0.10 wt % and Sb: 0.01 wt % to 0.05 wt %

Sn is added to lower the iron loss by increasing the number of secondary nuclei in the {110}<001> orientation in order to reduce the size of the secondary crystal grains. Further, Sn plays a vital role in inhibiting the grain growth through segregation in the grain boundaries, which compensates for the weakening of the effect of inhibiting the grain growth as the AlN grains are coarsened, and the Si content is increased. Thus, {110}<001> secondary recrystallized texture can be assured to be successfully formed even when the Si content is relatively high. In other words, it is possible not only to increase the Si content but also to reduce the final thickness without impairing the completeness of the {110}<001> secondary recrystallization structure.

When the Sn content is too high, the brittleness may be increased.

The Sn content may be controlled within the range as described above, thereby expecting a discontinuous and remarkable effect of reducing iron loss, which cannot be predicted in the conventional art. Therefore, the Sn content may be controlled to the range as described above.

Sb is segregated at grain boundaries to act to inhibit the excessive growth of the primary recrystallized grain. Sb is added to inhibit the grain growth in the primary recrystallization process, thereby eliminating the nonuniformity of the primary recrystallization grain size according to the thickness direction of the sheet and allowing the stable secondary recrystallization at once so as to produce grain-oriented electrical steel sheets having more excellent magnetic properties.

Sb is segregated at grain boundaries to inhibit the excessive growth of primary recrystallized grain. However, when the Sb content is too low, it may be difficult to function suitably.

When the Sb content is too high, the size of the primary recrystallized grain may become significantly small to lower the initial temperature of the secondary recrystallization, thereby deteriorating the magnetic properties, or the secondary recrystallization may not be formed due to excessive inhibition of grain growth. Therefore, the Sb content may be controlled to the range as described above.

Each of Sn and Sb may be included individually, or both may be included together. When each of them is included individually, Sn and Sb, respectively, may be included in an amount of 0.03 wt % to 0.10 wt % or 0.01 wt % to 0.05 wt %. When both Sn and Sb are included, the total amount of Sn and Sb may be 0.04 wt % to 0.15 wt %.

In addition to the metallurgical advantages as described above, when at least one of Sn and Sb used as the central element is added to the steel slab, it enhances the high-temperature oxidation resistance. In other words, when at least one of Sn and Sb is added, the concentration of forsterite ($Mg_2SiO_4$) is not increased in the innermost layer of the surface oxide layer. However, the nature of the innermost layer may change to decrease the diffusion rate into the oxidizing gas, thereby enhancing the high-temperature oxidation resistance.

The amount of at least one of Sn and Sb is a very critical precondition for the production of the base coating-free grain-oriented electrical steel sheets according to one exemplary embodiment of the present disclosure. In order for the base coating-free grain-oriented electrical steel sheet having excellent magnetic properties, the oxide layer 30 formed during the primary recrystallization annealing S40 should be induced to have a thin thickness, while the oxide layer 30 is prevented from penetrating deeply into the base metal layer 10. Here, the oxide layer 30 does not diffuse in the base metal layer 10 in the thickness direction thereof but is formed as a band-type thickening zone on the surface of the base metal layer 30. Here, the oxide layer 30 may be controlled to be thin, which have a thickness of 2 μm to 3 μm, while the oxygen amount of the oxide layer 30 increases to 600 ppm or more at the same time.

$0.0370 \leq [P]+0.5*[Sb] \leq 0.0630$ (wherein [P] and [Sb], respectively, refer to contents of P and Sb element (wt %))

When the content of [P]+0.5*[Sb] is controlled within the range as described above, an effect of improving iron loss may be increased. The reason is why, in general, elements may be added together so as to have a synergistic effect. Further, when the elements meet the range of the formula, the synergistic effect is maximized discontinuously compared to other numerical ranges. Therefore, it is possible to control each component range as well as to control [P]+0.5*[Sb] in the range as described above.

After operation of S10, the steel slab may be re-heated. When the steel slab is re-heated before the hot-rolling S20, the re-heating may be performed within a predetermined temperature range in which N and S to be solved are incompletely dissolved.

If N and S are entirely dissolved, a nitride or sulfide is formed in a significant amount after the hot-rolled sheet-annealing. Therefore, one-time hard cold-rolling process as a subsequent process becomes impossible and further processing is required so as to have a problem of an increase in production cost. Further, the primary recrystallized grain may be too fine to develop suitable secondary recrystallization. The re-heating temperature may be 1050° C. to 1250° C.

Next, the steel slab is hot-rolled to produce the hot-rolled sheet in operation S20. At this time, the thickness of the hot-rolled sheet may be 2.0 mm to 2.8 mm.

Next, the hot-rolled sheet is cold-rolled to produce the cold-rolled sheet in operation S30. The hot-rolled sheet may be cold-rolled after the hot-rolled sheet-annealing and pickling. At this time, the thickness of the cold-rolled sheet may be 1.5 mm to 2.3 mm.

Next, the cold-rolled sheet is primary recrystallization-annealed in operation S40.

When the cold-rolled sheet passes through a heating furnace, which is controlled in a wet atmosphere for the decarburization and nitriding, Si having the highest oxygen affinity in the composition of the cold-rolled sheet reacts with oxygen, which is supplied from aqueous vapor in the furnace, thereby forming a silica oxide ($SiO_2$) initially on the surface thereof. Then, oxygen permeates into the cold-rolled sheet so as to produce a Fe-based oxide. The produced silica oxide forms a forsterite ($Mg_2SiO_4$) film (base coating layer) by the following chemical reaction formula 1.

$$2Mg(OH)_2+SiO_2 \rightarrow Mg_2SiO_4+2H_2O \quad 1$$

In order to complete the chemical reaction in the reaction of silica oxide with a solid magnesium slurry as in the chemical reaction formula 1, a substance is required to serve as a catalyst so as to connect the two solids. Here, fayalite ($Fe_2SiO_4$) is suitable. Therefore, in the case of conventional materials including a base coating, the formation of the fayalite having a suitable amount was critical as well as the formation of silica oxide.

After the primary recrystallization annealing (decarburization annealing) of the electrical steel sheet, the shape of the oxide layer is such that the black colored oxide part is embedded in a metal matrix. This layer controls the temperature, the atmosphere, the dew point, and the like of the furnace so as to form a layer of 3 μm to 6 μm for forming the base coating well.

However, the glassless process has a concept of ultimately forming a base coating layer which interferes with the magnetic domain movement of the material at the front end of the high-temperature annealing process and then removing the base coating layer at the rear end thereof. Thus, a minimum amount of silica oxide is usually formed in the first recrystallization annealing process and then reacted with a slurry for annealing separation, which is substituted with magnesium hydroxide ($Mg(OH)_2$), so as to form a forsterite layer, thereby inducing its separation from the base material.

Therefore, in the conventional glassless manufacturing process, it is advantageous to reduce the silica oxide layer on the surface of the material and to produce a minimal amount of fayalite by controlling dew-point, soaking temperature, and atmosphere gas during the decarburization and nitriding process. The reason is why that fayalite, which is a material promoting the reaction between silica oxide and magnesium, is an iron-based oxide, which forms an iron-based oxide hill (hereinafter, referred to as "Fe mound") upon formation of a base coating, and the glassless-based additive is gasified to adhere to the surface of the material without falling off from the base material due to gasification. In this case, the glassless process is not only able to generate a product with a glossy surface targeted but also has very inferior magnetic properties.

Due to the processing problems of the glassless manufacturing process, in the conventional glassless process, the oxidativity is controlled to reduce the oxide layer during the primary recrystallization annealing. The composition of the produced oxide layer is mostly induced to include the silica oxide. Meanwhile the problem of lowering decarburization is solved by increasing decarburization treatment time. Therefore, the productivity is deteriorated. Further, the thin oxide layer causes the inhibitor present in the steel during high-temperature annealing to be diffused toward the surface and disappear suddenly, thereby resulting in unstable secondary recrystallization. Thus, the conventional glassless process applies a sequential pattern in which a high nitrogen atmosphere in the secondary recrystallization annealing and reduced heating rate in the heating section so that the inhibitor in the steel is prevented from diffusing to the surface. However, its productivity deterioration is inevitable as in the primary recrystallization annealing process.

As described above, when a product is manufactured by a conventional glassless process, its productivity is significantly lower than that of a conventional grain oriented electrical steel sheet having a base coating. Further, the specularity and magnetic variation of production lots are severe due to inhibitor instability at the high-temperature annealing. An exemplary embodiment of the present disclosure provides a method of increasing the amount of oxygen in the oxide layer 30 to form a glass film thoroughly and then separating the glass film thoroughly.

The oxide layer is a layer in which the inner oxide is embedded in the metal matrix and is different from the metal base layer 10 which is positioned inner in the thickness direction. Provided is a method of decreasing total thickness of the oxide layer 30 during increasing the amount of oxygen in the oxide layer 30 so as to form a glass film thoroughly. For this purpose, provided is a method of actively using the oxide layer 30 mechanism formed on the surface of the material and the segregation phenomenon of the segregation elements contained in the steel in the primary recrystallization annealing S40 so as to suitably maintain the segregation of segregation elements and temperature per section and oxidation, thereby controlling the amount of oxygen formed in the oxide layer to be high as a whole, instead of maintaining the thickness of the oxide layer 30 to be thin.

The oxide layer 30 becomes thick through the heating zone and the first soaking zone which is controlled to a wet atmosphere for decarburization in the primary recrystallization annealing S40. In an exemplary embodiment of the present disclosure, Sb or Sn, which is a segregation element, is segregated toward the interface between the oxide layer 30 and the metal base layer 10 in the primary recrystallization annealing S40 so as to form the segregation layer 20, thereby preventing the oxide layer 30 from becoming thick.

Figure 2:
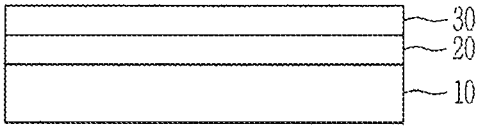
FIG. 2 is a schematic side view of the cold rolled steel sheet after step S40 in the method of manufacturing a grain oriented electrical steel sheet according to an exemplary embodiment of the present disclosure.

In other words, the metal base layer 10, the segregation layer 20, and the oxide layer 30 may be sequentially formed in operation S40, as the schematic view shown in FIG. 2. The segregation layer 20 is formed in which Sn and Sb are segregated in the metal base layer 10, which includes 0.001 wt % to 0.05 wt % of at least one of Sn and Sb. At this time, the thickness of the segregation layer 20 may be 0.1 μm to 4 μm.

Specifically, in operation S40, the oxide layer 30 formed on the surface of the cold-rolled sheet may have a thickness of 0.5 μm to 2.5 μm, and the oxide layer 30 may have an oxygen amount of 600 ppm or more. More specifically, the oxide layer 30 may have a thickness of 0.5 μm to 2.5 μm, and the oxide layer 30 may have an oxygen amount of 700 ppm to 900 ppm.

Operation S40 may be performed in an atmosphere of hydrogen, nitrogen and ammonia gas. Specifically, operation S40 may be performed in an atmosphere of containing 40 volume % to 60 volume % of nitrogen 0.1 volume % to 3 volume % of ammonia, with the remainder being hydrogen.

Operation S40 may be performed in which the sheet passes through the heating zone, the first soaking zone, the second soaking zone, and the third soaking zone. Here, a temperature may be 800° C. to 900° C. in the heating zone, the first soaking zone, the second soaking zone, and the third soaking zone.

The dew point of the heating zone may be 44° C. to 49° C. When the dew point of the heating zone is too low, the decarburization may become poor. When the dew point of the heating zone is too high, the oxide layer 30 is excessively produced. Thus, a significant amount of residue may be formed on the surface after the forsterite ($Mg_2SiO_4$) film is removed in operation S60. Therefore, the dew point of the heating zone may be controlled within the range as described above.

The oxidativity ($P_{H2O}/P_{H2}$) of the heating zone may be 0.197 to 0.262. When the oxidativity of the heating zone is too low, the decarburization may become poor. When the oxidativity of the heating zone is too high, the oxide layer 30 is excessively produced. Thus, a significant amount of residue may be formed on the surface after the forsterite ($Mg_2SiO_4$) film is removed in operation S60. Therefore, the oxidativity of the heating zone may be controlled within the range as described above.

The dew point of the first soaking zone may be 50° C. to 55° C. When the dew point of the first soaking zone is too low, the decarburization may become poor. When the dew point of the first soaking zone is too high, the oxide layer 30 is excessively produced. Thus, a significant amount of residue may be formed on the surface after the forsterite ($Mg_2SiO_4$) film is removed in operation S60. Therefore, the dew point of the first soaking zone may be controlled within the range as described above.

The oxidativity ($P_{H2O}/P_{H2}$) of the first soaking zone may be 0.277 to 0.368. When the oxidativity of the first soaking zone is too low, the decarburization may become poor. When the oxidativity of the first soaking zone is too high, the oxide layer 30 is excessively produced. Thus, a significant amount of residue may be formed on the surface after the forsterite ($Mg_2SiO_4$) film is removed in operation S60. Therefore, the oxidativity of the first soaking zone may be controlled within the range as described above.

The dew point of the second soaking zone may be 56° C. to 68° C. When the dew point of the second soaking zone is too low, the amount of oxygen in the oxide layer 30 becomes too small. When the dew point of the second soaking zone is too high, the oxide layer 30 is excessively produced. Thus, a significant amount of residue may be formed on the surface after the forsterite ($Mg_2SiO_4$) film is removed in operation S60. Therefore, the dew point of the second soaking zone may be controlled within the range as described above.

The oxidativity ($P_{H2O}/P_{H2}$) of the second soaking zone may be 0.389 to 0.785. When the oxidativity of the second soaking zone is too low, the amount of oxygen in the oxide layer 30 becomes too small. When the oxidativity of the second soaking zone is too high, the oxide layer 30 is excessively produced. Thus, a significant amount of residue may be formed on the surface after the forsterite ($Mg_2SiO_4$) film is removed in operation S60. Therefore, the oxidativity of the second soaking zone may be controlled within the range as described above.

The dew point of the third soaking zone may be 35° C. to 65° C. When the dew point of the third soaking zone is too low, the oxide layer 30 produced in the second soaking zone is reduced, and the oxide layer may become thin, resulting in unstable secondary recrystallization. When the dew point of the third soaking zone is too high, the oxide layer 30 is excessively produced. Thus, a significant amount of residue may be formed on the surface after the forsterite ($Mg_2SiO_4$) film is removed in operation S60. Therefore, the dew point of the third soaking zone may be controlled within the range as described above.

The oxidativity ($P_{H2O}/P_{H2}$) of the third soaking zone may be 0.118 to 0.655. When the oxidativity of the third soaking zone is too low, the amount of oxygen in the oxide layer 30 becomes too small. When the oxidativity of the third soaking zone is too high, the oxide layer 30 is excessively produced. Thus, a significant amount of residue may be formed on the surface after the forsterite ($Mg_2SiO_4$) film is removed in operation S60. Therefore, the oxidativity of the third soaking zone may be controlled within the range as described above.

The process time for the heating zone and the first soaking zone may be 30% or less of the total process time of the primary recrystallization-annealing, and the process time for the third soaking zone may be limited to 50% or less of the total process time of the heating zone, the first soaking zone, and the second soaking zone.

Next, in operation S50, the annealing separator is applied on the primary recrystallization annealed cold-rolled sheet and is dried. Specifically, the annealing separator may include MgO, an oxychloride material, and a sulfate-based antioxidant.

MgO is the main component of the annealing separator, which reacts with $SiO_2$ existing on the surface to form the forsterite ($Mg_2SiO_4$) film, as in the reaction formula 1 as described above.

The activativity of MgO may be 400 seconds to 3000 seconds. When the activativity of MgO is too high, there may be a problem of leaving spinel-based oxide ($MgO \cdot Al_2O_3$) on the surface after the secondary recrystallization annealing. When the activativity of MgO is too low, it may not react with the oxide layer 30 not to form a base coating layer. Therefore, the activativity of MgO may be controlled within the range as described above.

The oxychloride material is thermally decomposed in the secondary recrystallization annealing process (S60). The oxychloride material may include at least one selected from antimony oxychloride (SbOCl) and bismuth oxychloride (BiOCl). For example, the antimony oxychloride may be thermally decomposed at about 280° C. as shown in the following Chemical reaction formula 2.

$$2SbOCl \rightarrow Sb_2(s)+O_2(g)+Cl_2(g) \quad (2)$$

In the case of oxychloride-type chloride, Cl group is formed only by the thermal decomposition. Therefore, this causes a small amount of the production of the iron-based oxide which may inhibit roughness and glossiness and ultimately iron loss while the antimony oxychloride is produced in the slurry state in aqueous solution and then is applied and dried.

The separated chlorine (Cl) gas does not escape out of the coil due to the internal pressure of the heating furnace acting on the coil, but diffuses back and enter into the surface to form iron chloride ($FeCl_2$) at the interface between the segregation layer 20 and the oxide layer (Formula 3)

$$\text{Fe (segregation layer)}+Cl_2 \rightarrow FeCl_2 \text{ (interface between segregation layer and oxide layer)} \quad (3)$$

Then, in operation S60, a base coating is formed on the outermost surface according to the formula 1 by the reaction of magnesium slurry and the silica oxide at about 900° C. Then, the iron chloride ($FeCl_2$), formed at the interface between the segregation layer 20 and the oxide layer 30, starts to decompose at about 1025° C. to about 1100° C. The decomposed chlorine gas escapes from the outmost surface of the material so as to exfoliate the forsterite ($Mg_2SiO_4$) film (base coating) formed hereabove from the material.

The oxychloride material may be included in an amount of 10 parts by weight to 20 parts by weight based on 100 parts by weight of MgO. When the amount of the oxychloride material is too small, it is not possible to supply enough Cl to form sufficient $FeCl_2$. Thus, there may be restricted to enhance roughness and glossiness after operation S60. When the amount of the oxychloride material is too large, it may interfere with the base coating formation itself, thereby affecting metallurgically secondary recrystallization as well as the surface. Therefore, the amount of oxychloride material may be controlled within the range as described above.

The sulfate-based antioxidant is added to form a thin forsterite layer, produced by the reaction of MgO and $SiO_2$. Specifically, the sulfate-based antioxidant may include at least one selected from antimony sulfate ($Sb_2(SO_4)_3$), strontium sulfate ($SrSO_4$), and barium sulfate ($BaSO_4$).

The sulfate-based antioxidant may be included in an amount of 1 parts by weight to 5 parts by weight based on 100 parts by weight of MgO. When the amount of sulfate-based antioxidant is too low, it may not contribute to the improvement of roughness and glossiness thereof. When the amount of sulfate-based antioxidant is too large, it may interfere with the base coating formation itself. Therefore, the amount of sulfate-based antioxidant may be controlled within the range as described above.

The annealing separator may further include 800 parts by weight to 1500 parts by weight of water for applying the annealing separator smoothly. The application may be smoothly performed within the range as described above.

In operation S50, the application amount of the annealing separator may be 6 $g/m^2$ to 20 $g/m^2$. When the application amount of the annealing separator is too small, the base coating may not be formed smoothly. When the application amount of the annealing separator is too large, it may affect the secondary recrystallization. Therefore, the application amount of the annealing separator may be controlled within the range as described above.

In operation S50, the temperature for drying the annealing separator may be 300° C. to 700° C. When the temperature is too low, the annealing separator may be not dried easily. When the temperature is too high, it may affect the secondary recrystallization. Therefore, the drying temperature of the annealing separator may be controlled within the range as described above.

In operation S60, the secondary recrystallization annealing is performed on the cold-rolled sheet to which the annealing separator has been applied. In operation S60, a base coating is formed on the outermost surface according to the formula 1 by the reaction of magnesium slurry and the silica oxide at about 900° C. Then, the iron chloride ($FeCl_2$), formed at the interface between the segregation layer 20 and the oxide layer 30, starts to decompose at about 1025° C. to about 1100° C. The decomposed chlorine gas escapes from the outmost surface of the material so as to exfoliate the forsterite ($Mg_2SiO_4$) film (base coating) formed hereabove from the material.

In operation S60, the heating rate may be 18° C./hour to 75° C./hour in a temperature range of 700° C. to 950° C., and the heating rate may be 10° C./hour to 15° C./hour in a temperature range of 950° C. to 1200° C. in the secondary recrystallization annealing. The heating rate may be controlled within the range as described above so as to form the forsterite film readily.

In operation S60, the heating at 700° C. to 1200° C. may be performed in an atmosphere containing 20 volume % to 30 volume % of nitrogen and 70 volume % to 80 volume % of hydrogen, followed by performing in an atmosphere containing 100 volume % of hydrogen after reaching 1200° C. The atmosphere may be controlled within the range as described above so as to form the forsterite film readily.

In operation S60, the oxide layer 30 reacts with the annealing separator MgO so that the upper part of the oxide layer is changed to the forsterite layer and the lower part is present as the silicon oxide. Further, the segregation layer 20 is located at the lower part of the silicon oxide, thereby forming an interface with the metal base material.

With regard to the grain-oriented electrical steel sheet manufacturing method according to an exemplary embodiment of the present disclosure, the amount of oxide layer in the oxide layer 30 is almost the same as that of the conventional material, but the thickness of the oxide layer is thinner in 50% or less than that of conventional material. Thus, in the second annealing (S60), the forsterite layer can be easily removed, thereby obtaining a metallic glossy grain-oriented electrical steel sheet in which the magnetic domain of the base material is easy to move.

The grain-oriented electrical steel sheet manufacturing method results in an increase in the roughness and glossiness thereof. The grain-oriented electrical steel sheet manufactured by an exemplary embodiment of the present disclosure has a surface roughness Ra of 0.8 μm or less.

Figure 3:
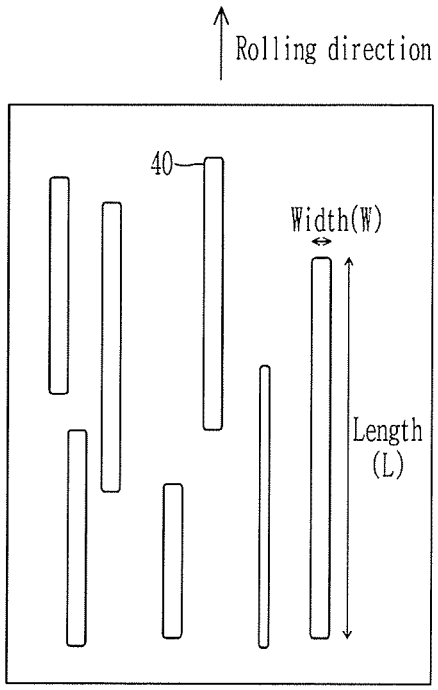
FIG. 3 is a schematic view of the surface of the grain oriented electrical steel sheet according to an exemplary embodiment of the present invention.

Further, as schematically shown in FIG. 3, the surface of the grain-oriented electrical steel sheet has a groove (protrusions and depressions) 40 parallel to the rolling direction. More specifically, the size of the groove 40 parallel to the rolling direction may be 3 μm to 500 μm in width (W) and 0.1 mm to 5 mm in length (L) of the rolling direction. Further, the aspect ratio (length/width, L/W) may be 5 or more. More specifically, the groove 40 parallel to the rolling direction, which has a length of 0.2 mm to 3 mm in the rolling direction and a width of 5 μm to 100 μm, may be included in an amount of 50% or more.

The grain-oriented electrical steel sheet manufactured in one exemplary embodiment of the present disclosure has relatively high roughness and reduced glossiness. This is why it takes relatively long time to delaminate the forsterite film at a temperature of about 1025° C. to about 1100° C. in operation S60, and therefore, the time for flattening the surface by a thermal source after the delamination is not sufficient. However, for corresponding to this, the stability of the inhibitor is excellent in operation S60, thereby acquiring magnetic properties easily.

Hereinafter, the present disclosure is described in more detail with reference to Examples. However, these Examples are only for illustrating the present disclosure, and the present disclosure is not limited thereto.

EXAMPLE

A steel slab was produced to include 3.2 wt % of Si, 0.055 wt % of C, 0.12 wt % of Mn, 0.026 wt % of Al, 0.0042 wt % of N, and 0.0045 wt % of S and further to include Sn, Sb, and P as shown in the following Table 1. The steel slab having the slab component system 1 was hot-rolled to produce a 2.8 mm hot-rolled sheet, then the hot-rolled sheet was annealed and pickled, and then the sheet was cold-rolled to produce the cold-rolled sheet having a final thickness of 0.23 mm.

TABLE 1

| slab component system | Si content (wt %) | Sn content (wt %) | P cntent (wt %) | Sb content (wt %) | Classification |
|---|---|---|---|---|---|
| 1 | 3.2 | 0.06 | 0.035 | 0.025 | Inventive material |
| 2 | 3.2 | — | — | — | Comparative material |

Figure 4:
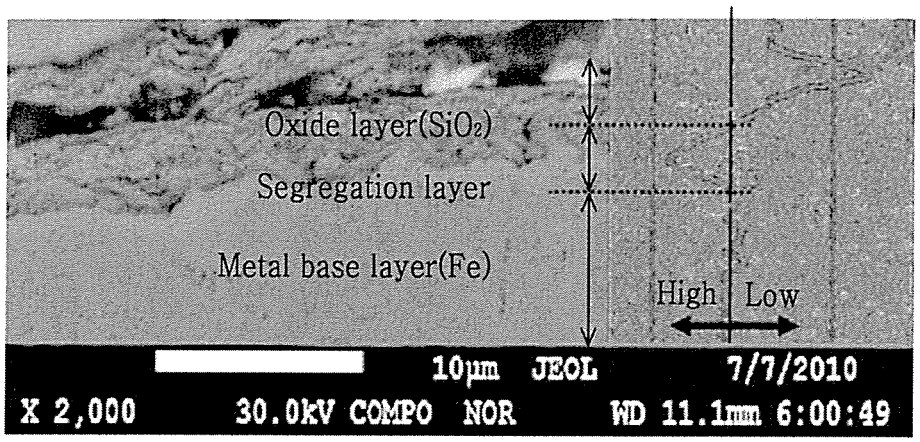
FIG. 4 is an image of the side surface of the cold-rolled sheet after step S40 in Exemplary Example 1, taken with a field emission-type transmission electron microscope (field emission-electron probe micro-analyzer, FE-EPMA) and the result of the analysis.

The cold-rolled steel sheet was then subjected to primary recrystallization annealing. Then, the steel sheet was maintained at a soaking temperature of 875° C. in a mixed atmosphere of 74 volume % hydrogen, 25 volume % of nitrogen, and 1 volume % of dry ammonia gas for 180 seconds, resulting in the decarburization and nitriding. At this time, the temperature of the heating zone, the first soaking zone, the second soaking zone and the third soaking zone were controlled within 800° C. to 900° C. Further, dew points of the heating zone, the first soaking zone, the second soaking zone and the third soaking zone were controlled to 48° C., 52° C., 67° C., and 58° C., respectively. FIG. 4 is an image of the side surface of the cold-rolled sheet after the primary recrystallization annealing, taken with a field emission-type transmission electron microscope (field emission-electron probe micro-analyzer, FE-EPMA). As shown in FIG. 4, it can be confirmed that the base metal layer, the segregation layer, and the oxide layer were sequentially formed and that the oxide layer is thinly formed to about 1 μm. It was analyzed that the oxygen content in the oxide layer was 0.065 wt %, and the Sn and Sb content in the segregation layer was 0.005 wt %.

Then, the annealing separator prepared by mixing 100 g of MgO with an activativity of 500 seconds, 5 g of SbOCl, 2.5 g of $Sb_2(SO_4)_3$ and 1000 g of water was applied at 10 g/m$^2$, and then the sheet was secondary recrystallization annealed in a coiled state. The first soaking temperature and the second soaking temperature were set to 700° C. and 1200° C., respectively in the secondary recrystallization annealing. In the heating section, the heating condition was set to 45° C./hr at a temperature section of 700° C. to 950° C. and 15° C./hr at a temperature section of 950° C. to 1200° C.

Figure 5:
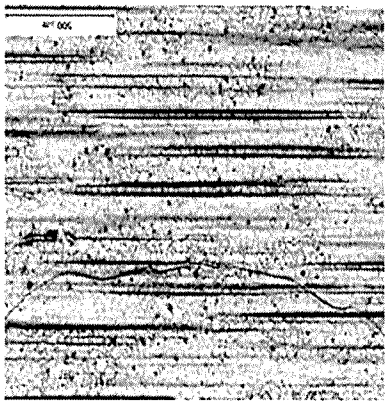
FIG. 5 is an image of the grain oriented electrical steel sheet prepared in Exemplary Example 1, taken with a scanning electron microscope (SEM)
Figure 5:
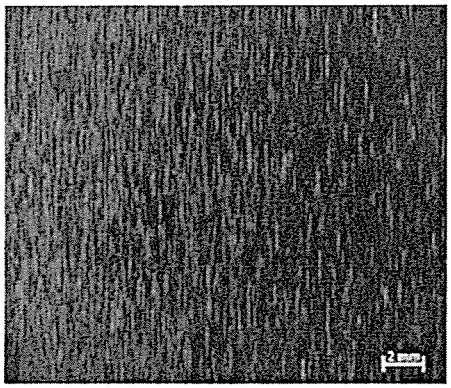
Figure 6:
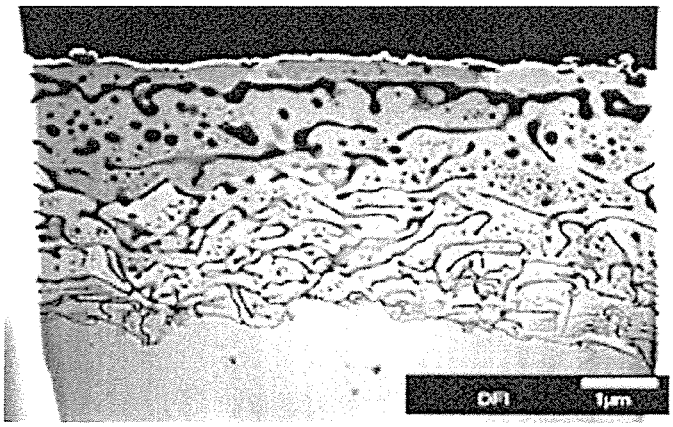
FIG. 6 is an image of the side surface of the cold-rolled sheet after step (S40) in Comparative Example 1, taken with a field emission-type transmission electron microscope (field emission-electron probe micro-analyzer, FE-EPMA).

Meanwhile, the soaking was performed in which the soaking time was set to 15 hours at 1200° C. The final annealing was performed at a mixed atmosphere of 25 volume % nitrogen and 75 volume % hydrogen up to 1200° C., and after reaching 1200° C., the sheet was maintained at an atmosphere of 100 vol % hydrogen. Then, the sheet was cooled in the furnace. FIG. 5 is an image of the grain oriented electrical steel sheet prepared in Exemplary Example 1, taken with a scanning electron microscope. As shown in FIG. 5, it was confirmed that a groove having a length (L) of 0.1 mm to 5 mm in the rolling direction and a width (W) of 3 μm to 500 μm was produced, and that the groove having a length of 0.2 mm to 3 mm in the rolling direction and a width of 5 μm to 100 μm was 50% or more.

Exemplary Example 2 and Comparative Examples 1 to 16

The component system of the steel slab was changed to those shown in the following Table 2. The dew point of the heating zone, the first soaking zone, the second soaking zone and the third soaking zone in the primary annealing process were adjusted as shown in the following Table 2. The annealing separator was adjusted as shown in the following Table 2. Thus, the grain-oriented electrical steel sheets were prepared.

TABLE 2

| | Slab | Primary recrystallization annealing dew-point condition (° C.) | | | | | Annealing separator (g) | | | |
|---|---|---|---|---|---|---|---|---|---|---|
| | component system | heaitng | Soaking 1 | Soaking 2 | Soaking 3 | Oxygen content (ppm) | MgO | $BiCl_3$ | SbOCl | $Sb_2$ $(SO_{43}$ |
| Exemplary Example 1 | 1 | 48 | 52 | 67 | 58 | 735 | 100 | — | 5 | 2.5 |
| Exemplary Example 2 | 1 | 49 | 54 | 66 | 48 | 712 | 100 | 5 | — | — |
| Comparative Example 1 | 1 | 62 | 65 | 65 | 38 | 850 | 100 | — | — | — |
| Comparative Example 2 | 1 | 62 | 65 | 65 | 38 | 852 | 100 | 5 | — | — |
| Comparative Example 3 | 1 | 62 | 65 | 65 | 38 | 868 | — | — | 5 | 2.5 |
| Comparative Example 4 | 1 | 56 | 56 | 56 | 38 | 455 | 100 | — | — | — |
| Comparative Example 5 | 1 | 56 | 56 | 56 | 38 | 478 | 100 | 5 | — | — |
| Comparative Example 6 | 1 | 56 | 56 | 56 | 38 | 463 | — | — | 5 | 2.5 |
| Comparative Example 7 | 1 | 56 | 56 | 56 | 38 | 466 | 100 | 5 | — | — |
| Comparative Example 8 | 1 | 56 | 56 | 56 | 38 | 437 | — | — | 5 | 2.5 |
| Comparative Example 9 | 2 | 62 | 65 | 65 | 38 | 780 | 100 | — | — | — |
| Comparative Example 10 | 2 | 62 | 65 | 65 | 38 | 778 | — | 5 | — | — |
| Comparative Example 11 | 2 | 62 | 65 | 65 | 38 | 792 | — | — | 5 | 2.5 |
| Comparative Example 12 | 2 | 56 | 56 | 56 | 38 | 380 | 100 | — | — | — |
| Comparative Example 13 | 2 | 56 | 56 | 56 | 38 | 376 | 100 | 5 | — | — |

TABLE 2-continued

| | Slab | Primary recrystallization annealing dew-point condition (° C.) | | | | | Annealing separator (g) | | | |
|---|---|---|---|---|---|---|---|---|---|---|
| | component system | heaitng | Soaking 1 | Soaking 2 | Soaking 3 | Oxygen content (ppm) | MgO | $BiCl_3$ | SbOCl | $Sb_2$ $(SO_{43}$ |
| Comparative Example 14 | 2 | 56 | 56 | 56 | 38 | 373 | — | — | 5 | 2.5 |
| Comparative Example 15 | 2 | 56 | 56 | 56 | 38 | 412 | 100 | 5 | — | — |
| Comparative Example 16 | 2 | 56 | 56 | 56 | 38 | 398 | — | — | 5 | 2.5 |

As shown in Table 3, Exemplary Examples 1 and 2 have a thin thickness of the oxide layer compared with those of Comparative Examples, so that the forsterite layer was easily removed during the secondary recrystallization annealing. Therefore, it was possible to obtain a metallic glossy-type grain-oriented electrical steel sheet in which the magnetic domain can be easily moved.

Experimental Example

The roughness, glossiness, iron loss and magnetic flux density of grain-oriented electrical steel sheets prepared in Exemplary Examples 1 and 2 and Comparative Examples 1 to 16 were measured, and the results are showed in the following Table 3. The glossiness is Gloss in which the amount of light reflected the surface measured at a reflection angle of 60° is based on the mirror surface glossiness 1000.

TABLE 3

| | roughness (Ra:mm) | glossiness (index) | Iron loss ($W_{17/50}$) | magnetic flux density $B_8$ |
|---|---|---|---|---|
| Exemplary Example 1 | 0.45 | 320 | 0.85 | 1.93 |
| Exemplary Example 2 | 0.35 | 300 | 0.87 | 1.92 |
| Comparative Example 1 | 0.65 | 52 | 0.97 | 1.91 |
| Comparative Example 2 | 0.68 | 47 | 1.20 | 1.85 |
| Comparative Example 3 | 0.61 | 50 | 1.15 | 1.87 |
| Comparative Example 4 | 0.67 | 48 | 0.96 | 1.91 |
| Comparative Example 5 | 0.63 | 46 | 1.38 | 1.83 |
| Comparative Example 6 | 0.68 | 42 | 1.32 | 1.84 |
| Comparative Example 7 | 0.33 | 309 | 0.92 | 1.88 |
| Comparative Example 8 | 0.35 | 332 | 0.91 | 1.89 |
| Comparative Example 9 | 0.71 | 39 | 0.95 | 1.91 |
| Comparative Example 10 | 0.61 | 51 | 1.18 | 1.86 |
| Comparative Example 11 | 0.63 | 53 | 1.12 | 1.88 |
| Comparative Example 12 | 0.70 | 45 | 0.96 | 1.91 |
| Comparative Example 13 | 0.30 | 201 | 1.38 | 1.83 |
| Comparative Example 14 | 0.35 | 255 | 1.32 | 1.84 |
| Comparative Example 15 | 0.28 | 362 | 0.91 | 1.90 |
| Comparative Example 16 | 0.26 | 382 | 0.90 | 1.90 |

As shown in Table 3, Exemplary Examples 1 and 2 have a thin thickness of the oxide layer compared with those of Comparative Examples, so that the forsterite layer was easily removed during the secondary recrystallization annealing. Therefore, it was possible to obtain a metallic glossy-type grain-oriented electrical steel sheet in which the magnetic domain can be easily moved. On the other hand, the amount of oxygen in the oxide layer is similar to those of Comparative Examples, so that the decarburization of the base material is excellent. Thus, it can be confirmed that the inhibitor was stable during the secondary recrystallization annealing is stable, thereby eliciting high productivity as well as great magnetism.

The present disclosure is not limited to exemplary embodiments but can be carried out in various forms. It will be apparent to those skilled in the art that the present disclosure can be carried out in a specific form without changing the technical concept or essential characteristics thereof. It is, therefore, to be understood that Exemplary Examples as described are illustrative in all aspects and not restrictive.

| <Description of symbols> | |
|---|---|
| 10: metal base layer | 20: Segregation layer |
| 30: oxide layer | 40: groove |

The invention claimed is:

1. A method for manufacturing grain-oriented electrical steel sheet, the method comprising: manufacturing a steel slab comprising 2 wt % to 7 wt % of Si, 0.03 wt % to 0.10 wt % of Sn, and 0.01 wt % to 0.05 wt % of Sb;

hot-rolling the steel slab to produce a hot-rolled sheet;

cold-rolling the hot-rolled sheet to produce a cold-rolled sheet;

primary recrystallization-annealing the cold-rolled sheet through a heating zone, a first soaking zone, a second soaking zone and a third soaking zone;

applying an annealing separator to the primary recrystallization-annealed cold-rolled sheet and drying; and applying a secondary recrystallization-annealing to the primary recrystallization-annealed cold-rolled sheet on which the annealing separator is applied and dried, wherein after the primary recrystallization-annealing:

a layered structure is formed including a base metal, a segregation layer, and an oxide layer;

the oxide layer is formed on a surface of the primary recrystallization-annealed cold-rolled sheet, wherein the oxide layer has a thickness of 0.5 μm to 2.5 μm, and an oxygen amount of of 700 ppm to 900 ppm; and the segregation layer is formed between the base metal and oxide layer, wherein the segregation layer includes 0.001 wt % to 0.05 wt % of Sn and Sb, wherein a forsterite, $Mg_2SiO_4$, film is removed in the secondary recrystallization-annealing, wherein the temperatures of the heating zone, the first soaking zone, the second soaking zone, and the third soaking zone are 800° C. to 900° C., wherein a dew-point of the heating zone is 44° C. to 49° C., a dew-point of the first soaking zone is 50° C. to 55° C., a dew-point of the second soaking zone is 56° C. to 68° C., and a dew-point of the third soaking zone is 48° C. to 65° C., wherein grooves parallel to the rolling direction are formed on a surface of a sheet after secondary recrystallization-annealing, wherein each of the grooves has a length of 0.2 mm to 3 mm and a width of 5 μm to 100 μm, and the grooves are formed in an amount of 50% or more of the surface of the sheet after the secondary recrystallization-annealing, and the length is parallel to the rolling direction and the width is perpendicular to the rolling direction.

2. The method of claim 1, wherein:

the steel slab further comprises 0.01 wt % to 0.085 wt % of C, 0.01 wt % to 0.045 wt % of Al, 0.01 wt % or less of N, 0.01 wt % to 0.05 wt % of P, 0.02 wt % to 0.5 wt % of Mn, and more than 0% and 0.0055 wt % or less of S with the remainder being Fe and other unavoidable impurities.

3. The method of claim 1, wherein:

the steel slab further comprises 0.01 wt % to 0.05 wt % of Sb and 0.01 wt % to 0.05 wt % of P and satisfies $0.0370 \leq [P]+0.5*[Sb] \leq 0.0630$, wherein [P] and [Sb], respectively refer to P wt % content and Sb wt % content.

4. The method of claim 1, wherein:

an oxidation ability, $P_{H2O}/P_{H2}$, of the heating zone is 0.197 to 0.262, wherein an oxidation ability of the first soaking zone is 0.277 to 0.368, wherein an oxidation ability of the second soaking zone is 0.389 to 0.785, and wherein an oxidation ability of the third soaking zone is 0.118 to 0.655.

5. The method of claim 1, wherein:

a process time for the heating zone and the first soaking zone is 30% or less of a total process time of the primary recrystallization-annealing, and wherein a process time for the third soaking zone is limited to 50% or less of a total process time of the heating zone, the first soaking zone, and the second soaking zone.

6. The method of claim 1 where each of the grooves is in a form of a rectangle.

7. The method of claim 6, wherein each of the grooves in the form of the rectangle has a length/width aspect ratio of 5 or more.

8. The method of claim 1, wherein:

the annealing separator includes MgO, an oxychloride material, and a sulfate-based antioxidant.

9. The method of claim 8, wherein:

the annealing separator includes 10 parts by weight to 20 parts by weight of the oxychloride material and 1 part by weight to 5 parts by weight of the sulfate-based antioxidant, based on 100 parts by weight of MgO.

10. The method of claim 8, wherein:

the oxychloride material includes at least one selected from SbOCl and BiOCl.

11. The method of claim 8, wherein:

the sulfate-based antioxidant includes at least one selected from $Sb_2(SO_4)_3$, $SrSO_4$ and $BaSO_4$.

12. The method of claim 1, wherein:

a temperature for drying the annealing separator is 300° C. to 700° C.

13. The method of claim 1, wherein:

a heating rate is 18° C./hour to 75° C./hour in a temperature range of 700° C. to 950° C. and a heating rate is 10° C./hour to 15° C./hour in a temperature range of 950° C. to 1200° C. in the secondary recrystallization annealing.

14. The method of claim 13, wherein:

the heating at 700° C. to 950° C. and the heating at 950° C. to 1200° C. are each performed in an atmosphere containing 20 volume % to 30 volume % of nitrogen and 70 volume % to 80 volume % of hydrogen, followed by performing the secondary recrystallization annealing in an atmosphere containing 100 volume % of hydrogen after reaching 1200° C.

15. The method of claim 1, wherein:

the grain-oriented electrical steel sheet after secondary recrystallization-annealing has a surface roughness of 0.8 μm or less in terms of Ra.

* * * * *